US010414034B2

(12) United States Patent
Lilja et al.

(10) Patent No.: US 10,414,034 B2
(45) Date of Patent: Sep. 17, 2019

(54) PNEUMATIC HAMMER DEVICE AND A METHOD PERTAINING TO A PNEUMATIC HAMMER DEVICE

(71) Applicant: CONSTRUCTION TOOLS PC AB, Kalmar (SE)

(72) Inventors: Thomas Lilja, Kalmar (SE); Olof Östensson, Kalmar (SE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 643 days.

(21) Appl. No.: 15/033,786

(22) PCT Filed: Oct. 24, 2014

(86) PCT No.: PCT/SE2014/051256
§ 371 (c)(1),
(2) Date: May 2, 2016

(87) PCT Pub. No.: WO2015/065270
PCT Pub. Date: May 7, 2015

(65) Prior Publication Data

US 2016/0297058 A1 Oct. 13, 2016

(30) Foreign Application Priority Data

Nov. 1, 2013 (SE) ..... 1351298

(51) Int. Cl.
*B25D 9/16* (2006.01)
*B25D 9/14* (2006.01)
*B25D 16/00* (2006.01)

(52) U.S. Cl.
CPC ..... *B25D 9/16* (2013.01); *B25D 9/14* (2013.01); *B25D 16/00* (2013.01); *B25D 2250/181* (2013.01); *B25D 2250/245* (2013.01)

(58) Field of Classification Search
CPC . B25D 9/16; B25D 9/14; B25D 16/00; B25D 2250/181; B25D 2250/245
See application file for complete search history.

(56) References Cited

U.S. PATENT DOCUMENTS 3,552,269 A 1/1971 Arndt
3,780,621 A 12/1973 Romell
(Continued)

FOREIGN PATENT DOCUMENTS

CN 1750907 A 3/2006
EP 0578623 A2 1/1994
(Continued)

OTHER PUBLICATIONS

Australian Office Action (Examination Report) in corresponding application No. 2014343102 dated Nov. 3, 2017 (3 pages).
(Continued)

*Primary Examiner* — Andrew M Tecco
*Assistant Examiner* — Praachi M Pathak
(74) *Attorney, Agent, or Firm* — Venable LLP; Jeffri A. Kaminski

(57) ABSTRACT

A pneumatic hammer including a connector for connection to an external compressed air source and a striking mechanism. The striking mechanism includes a housing and a piston arranged for reciprocating motion in the housing. The striking piston has front and rear piston portions. The piston and the housing form front and rear spaces. A compressed air conduit is arranged in airflow communication with the front space via a second passage in the housing, at which second passage a first valve is arranged. There is an intermediate space between the front and rear piston portions and the housing. The control unit is alternately subjected to air pressure of the rear space with respect to the intermediate space during reciprocating motion of the piston. The control
(Continued)

unit controls the first valve based on air pressure to alternately supply compressed air to the front space and achieving a return movement of the piston.

15 Claims, 3 Drawing Sheets

(56) References Cited

U.S. PATENT DOCUMENTS

| | | | | | |
|---|---|---|---|---|---|
| 4,179,983 | A * | 12/1979 | Wallace | F01B 11/02 | 173/208 |
| 4,363,365 | A | 12/1982 | Nikolaev et al. | | |
| 4,635,531 | A | 1/1987 | Rode | | |
| 4,646,854 | A * | 3/1987 | Arndt | B25D 9/145 | 173/207 |
| 4,676,323 | A * | 6/1987 | Henriksson | B25D 9/12 | 138/30 |
| 5,064,005 | A * | 11/1991 | Krone | B25D 9/12 | 173/208 |
| 5,210,918 | A * | 5/1993 | Wozniak | B25D 9/14 | 173/17 |
| 5,417,294 | A * | 5/1995 | Suher | B25D 9/14 | 173/15 |
| 5,529,132 | A * | 6/1996 | Evarts | E02D 7/10 | 173/1 |
| 5,653,295 | A * | 8/1997 | Juvonen | B25D 9/145 | 173/207 |
| 5,860,481 | A * | 1/1999 | Prokop | B25D 9/14 | 173/17 |
| 6,334,495 | B2 * | 1/2002 | Deimel | B25D 9/14 | 173/115 |
| 6,467,554 | B1 * | 10/2002 | Millican | E21B 4/145 | 173/91 |
| 6,491,114 | B1 * | 12/2002 | Webel | E02F 3/966 | 173/11 |
| 6,672,403 | B2 * | 1/2004 | Ahr | B25D 9/265 | 173/1 |
| 7,779,930 | B2 * | 8/2010 | Lohmann | B25D 9/265 | 173/115 |
| 9,701,003 | B2 * | 7/2017 | Moore | B25D 9/12 | |
| 9,868,197 | B2 * | 1/2018 | Dirr | E21B 4/14 | |
| 10,022,850 | B2 * | 7/2018 | Lee | B25D 9/12 | |
| 2007/0267223 | A1 | 11/2007 | Andersson et al. | | |
| 2007/0295523 | A1 * | 12/2007 | Chen | B25D 9/04 | 173/168 |
| 2008/0073095 | A1 | 3/2008 | Henriksson et al. | | |
| 2009/0321099 | A1 | 12/2009 | Birath | | |

FOREIGN PATENT DOCUMENTS

| | | | |
|---|---|---|---|
| SE | 383281 | B | 3/1976 |
| WO | 2004073932 | A1 | 9/2004 |
| WO | WO-2006022584 | A1 | 3/2006 |

OTHER PUBLICATIONS

Supplementary European Search Report filed on Mar. 23, 2017 in European Application No. 14857160.7.

PCT/ISA/210—International Search Report—dated Jan. 28, 2015 (Issued in Application No. PCT/SE2014/051256).

PCT/ISA/237—Written Opinion of the International Searching Authority—dated Jan. 28, 2015 (Issued in Application No. PCT/SE2014/051256).

* cited by examiner

PNEUMATIC HAMMER DEVICE AND A METHOD PERTAINING TO A PNEUMATIC HAMMER DEVICE

CROSS-REFERENCE TO RELATED APPLICATIONS

This application claims priority to Swedish patent application 1351298-3 filed 1 Nov. 2013 and is the national phase under 35 U.S.C. § 371 of PCT/SE2014/051256 filed 24 Oct. 2014.

TECHNICAL FIELD

The present invention relates to a pneumatic hammer device. The invention also relates to a method pertaining to a pneumatic hammer device.

BACKGROUND

Pneumatic striking tools have existed for several decades and may be constituted by, for example, drilling machines with striking impact or breakers. The striking tools may be hand-held by an operator or arranged on a rig and may be used vertically or horizontally. Regardless of the application range, all the striking tools have in common that they comprise a striking mechanism with a striking piston arranged in a striking mechanism housing. The striking piston is arranged for reciprocating motion by impact of supplied compressed air. The striking piston is moved forward by compressed air and strikes an insert tool, such as a drilling steel, an iron bar or similar at its front position, and an impact wave transmission to the insert tool is thereby achieved. After the strike against the insert tool, compressed air is supplied such that the striking piston obtains a return movement.

The pressure build up that occurs in the striking mechanism to accelerate and move the striking piston generates reaction forces. These reaction forces affect the striking mechanism housing and cause vibrations which may be perceived as unpleasant for the operator. Today, there are restrictions on how much vibration an operator should be exposed to daily. Machines with high vibration levels may thus be used for a shorter time than machines with low vibration levels. It is desirable to minimize the arising vibrations from the striking tool and thus prolong the time that an operator can work with the striking tool without negative impact. The vibrations of the striking mechanism housing, the insert tool and venting of the compressed air also cause unwanted sound emissions, which may be perceived as disturbing for people in the surrounding area. Furthermore, the vibrations result in fatigue loads of the striking tool.

Various solutions to minimize the occurrence of vibrations and noise emissions exist on the market. According to one solution, the handle of the striking tool is spring suspended, which reduces the vibrations of the striking tool. According to another solution, a sound dampening casing is arranged around the striking mechanism housing to reduce sound emissions.

Document SE383281 shows a striking tool comprising a striking piston movably arranged in a cylinder, which has a front and a rear cylinder chamber. To reduce the reaction forces arising at the striking tool and the thereby arising vibrations, compressed air is supplied with a substantially constant pressure to the rear cylinder space, which both accelerates the striking piston forward and decelerates the striking piston at its backward movement. Cavities arranged at the striking piston causes compressed air to be supplied to the front cylinder space and an accumulator, which results in that the striking piston is moved backward in the cylinder. Due to the limited size of the accumulator chamber a pressure is however built up in the front cylinder chamber upon striking, which decelerates the striking piston and reduces the striking tools striking impact. The configuration of the striking tool also results in throttling of the compressed air supply and thereby pressure drop when the striking piston shall be accelerated. The pressure drop generates heat, which causes a reduced efficiency of the striking tool.

Despite known solutions in the field, there is a need to achieve an ergonomical striking tool with minimal vibrations and sound emissions while generating required striking force.

SUMMARY OF THE INVENTION

An object of the present invention is to provide a hammer device which minimizes occurrence of vibrations.

Another object of the invention is to provide a hammer device which causes a minimum of sound emissions.

A further object of the invention is to provide a hammer device which is ergonomic and user friendly.

Another object of the invention is to provide a hammer device having a high efficiency.

A further object of the invention is to provide a hammer device having an optimum striking energy.

Another object of the invention is to provide a hammer device which results in a high processing capability.

A further object of the invention is to provide a method pertaining to a hammer device which causes a minimum of vibrations and sound emissions.

Another object of the invention is to provide an alternative hammer device and an alternative method pertaining to a hammer device.

According to an aspect of the invention, a pneumatic hammer device is provided, which hammer device comprises connecting means arranged for connection to a compressed air conduit of an external compressed air source, and a striking mechanism, which striking mechanism comprises a striking mechanism housing and a striking piston arranged for reciprocating motion in said striking mechanism housing, which striking piston has a front piston portion and a rear piston portion, wherein the front piston portion affects an insert tool arranged at the hammer device, wherein the striking piston and the striking mechanism housing together form a front space and a rear space, wherein the front space is limited rearwards by the front piston portion and the rear space is limited forwards by the rear piston portion, wherein said compressed air conduit is arranged in air flow communication with the rear space via a first passage in the striking mechanism housing, and wherein said compressed air conduit is arranged in air flow communication with the front space via a second passage in the striking mechanism housing, wherein a first valve means is arranged at the second passage, wherein the striking piston is configured such that an intermediate space is formed between the front piston portion and the rear piston portion and the striking mechanism housing, wherein control means are arranged to alternately be subjected to an air pressure of said rear space respectively said intermediate space during the striking piston's reciprocating motion, and wherein said control means are arranged for controlling said first valve means on the basis of said air pressure for alternately supplying compressed air to the front space and providing a return movement of the striking piston.

The air pressure of the intermediate space is preferably different from the air pressure of the rear space.

The compressed air supplied to the rear space acts on the striking piston such that it moves forward in the striking mechanism housing. When the striking piston reaches a forward position, the front piston portion strikes the insert tool, resulting in an energy transfer. The compressed air supplied to the front space acts on the striking piston such that it moves rearward in the striking mechanism housing. By controlling the first valve means by means of the control means, on the basis of the air pressure at the rear space respectively the intermediate space, an optimum control of the supply of compressed air to the front space is achieved. This way, a hammer device having a high processing capability and a high efficiency is achieved.

Preferably, compressed air is supplied into the rear space constantly during use of the hammer device according to the present invention. In this way, a substantially constant air pressure acts on the rear piston portion, both during forward movement and return movement of the striking piston. By providing a substantially constant pressure in the rear space, the reaction forces acting on the striking mechanism housing are reduced. This way, a hammer device which minimizes the occurrence of vibrations is achieved.

A valve means is defined as a means which is used to regulate or control an opening in a fluid system and thereby to control the flow of gas or liquid. The valve means in the present invention may comprise a variety of valve types, for example a magnetic valve, ball valve, 3/2 valve or similar.

According to an aspect of the present invention, the striking mechanism housing is configured as a cylinder and has a front portion and a rear portion, wherein the front portion has a larger inner diameter than the rear portion, A contact surface is formed at the diameter transition between the front portion and the rear portion. The contact surface may act as a mechanical stop for the rearward movement of the striking piston when the hammer device is switched off. Alternatively, said mechanical stop may be provided by the rear piston portion striking the rear end of the striking mechanism housing.

The hammer device preferably comprises a front part with a bushing for connection of the insert tool to the hammer device. The front part is preferably formed integrally with the front portion of the striking mechanism housing. Alternatively, the front part is removably arranged at the front portion of the striking mechanism housing.

The handles of the hammer device are preferably arranged at the rear portion of the striking mechanism housing. The handles may be provided with a vibration-damping spring suspension which further reduces the vibrations that the operator is exposed to. The handles may further be formed with a T-shape, D-shape, as a pistol grip or similar.

In order to reduce the sound emissions which the hammer device emits, a sound dampening casing is preferably arranged around the striking mechanism housing. The sound dampening casing dampens both metallic sound emissions and sound emissions from venting passages of the hammer device.

According to an aspect of the present invention, the striking piston is a differential piston having areas subjected to different pressures.

According to an aspect of the present invention, the striking piston is configured such that the front piston portion comprises a first portion and a second portion, wherein the first portion has a larger diameter than the second portion. The second portion of the front piston portion is arranged at the very front of the striking piston and closest to the insert tool. The first portion of the front piston portion has substantially the same diameter as the inner diameter of the front portion of the striking mechanism housing. The front space is thus limited rearwards by the first portion of the front piston portion. The rear piston portion has a smaller diameter than the first portion of the front piston portion. The rear piston portion has substantially the same diameter as the inner diameter of the rear portion of the striking mechanism housing. Preferably, an intermediate portion extends between the front piston portion and the rear piston portion, which intermediate portion has a smaller diameter than the first portion of the front piston portion and the rear piston portion.

Preferably, the striking piston is configured such that a hammer device is achieved which results in a high processing capacity. An impact wave is generated during strikes by the striking piston on the insert tool, which impact wave generates a local compression of the insert tool. The stress in the insert tool therefore varies over time. The impact wave is affected by the geometric configuration of the striking piston. A long piston with a small diameter generates an impact wave with a low stress level during a long time. A short striking piston with a large diameter generates an impact wave with a high stress level during a short time. When the hammer device is used in breaking applications a certain minimum stress level for breaking through the ground is required. Too high stress levels however wears on the insert tool and therefore causes a short service life of the insert tool. The striking piston of the present invention is preferably configured with a length-diameter-ratio that causes an impact wave with a slightly lower stress level during a longer time compared to prior art.

According to an aspect of the present invention, the front space, the intermediate space and the rear space are separated and sealed by circumferential slot seals between the first part of the front piston portion and the striking mechanism housing and between the rear piston portion and the striking mechanism housing. The play between the striking piston and the striking mechanism housing is preferably less than 60 micrometer. By using slot seals, the friction between the striking piston and the striking mechanism housing is minimized. In this way, a hammer device having an optimized striking impact is achieved.

Alternatively, the front space, the intermediate space and the rear space are separated and sealed by sealing means, for example O-rings or piston rings, arranged between the first part of the front piston portion and the striking mechanism housing and between the rear piston portion and the striking mechanism housing.

According to an aspect of the present invention, the hammer device comprises a first venting passage arranged in said striking mechanism housing for maintaining atmospheric pressure at said intermediate space. Due to that the intermediate space is in constant communication with the atmosphere, the control means will be subjected to atmospheric pressure when the striking piston is in a position such that the control means are in communication with the intermediate space. When the striking piston is in a position such that the control means are in communication with the rear space, the control means are subjected to an air pressure corresponding to the pressure of the compressed air supplied to the rear space.

The compressed air supplied to the rear space and the front space from the compressed air conduit has for example a pressure between 5-30 bar.

According to an aspect of the present invention, the intermediate space has an air pressure near the atmospheric pressure. Alternatively, the intermediate space has an air pressure different from the atmospheric pressure and different from the air pressure in the rear space. The air pressure at the intermediate space is for example lower than the air pressure at the rear space.

According to an aspect of the present invention, the control means comprise a control passage arranged at the striking mechanism housing and a control conduit arranged between the control passage and the first valve means.

According to an aspect of the present invention, the first valve means is constituted by a mechanically controlled valve with a first idle position and a controlled second position. The first valve means may comprise a spring device which causes the first valve means to be closed in the idle position and the first valve means to open under the impact of the spring device. The spring device may comprise a mechanical spring or an air spring. When the control passage is in communication with the rear space the compressed air supplied to the rear space flows via the control passage into the control conduit. The pressure in the control conduit thereby increases and acts on the mechanically controlled valve such that it switches to the second open position. When the striking piston is in a position such that the control passage is in communication with the intermediate space, which is connected to the atmosphere, the pressure in the control conduit decreases and the first valve means returns to its closed idle position. Alternatively, the first valve means is open in the idle position and closed in the second controlled position.

Alternatively, the first valve means is constituted by a mechanically controlled valve with a first controlled position and a second controlled position. When the control passage is in communication with the rear space the compressed air supplied to the rear space flows via the control passage into the control conduit. The pressure in the control conduit thus increases and the mechanically controlled valve is controlled to the first position such that it opens. When the striking piston is in a position such that the control passage is in communication with the intermediate space which is connected to the atmosphere, the pressure in the control conduit decreases and the first valve means is controlled to the second closed position.

Alternatively, a control means is also arranged at the striking mechanism housing such that it is in communication with the front space and the intermediate space, depending on the position of the striking piston in the striking mechanism housing. It is thereby possible to control the first valve means with two separate control means, to a controlled open position and to a controlled closed position.

Alternatively, the control means comprise a pressure sensor arranged at the striking mechanism housing and an electric cable arranged between the pressure sensor and the first valve means.

Alternatively, the first valve means is constituted by an electrically controlled valve. When the pressure sensor is in communication with the rear space, the pressure sensor is subjected to an air pressure corresponding to the pressure of the compressed air supplied to the rear space. The pressure sensor then sends a first electrical signal via the electric cable to the first valve means, which thereby is controlled to an open position. When the striking piston is in a position such that the pressure sensor is in communication with the intermediated space, the pressure sensor is subjected to the air pressure of the intermediate space. The pressure sensor then sends a second signal to the electrically controlled valve, which thereby is controlled to a closed position.

According to an aspect of the present invention, the hammer device comprises a second venting passage arranged at the striking mechanism housing such that it is in communication with the front space when the control means are in communication with the intermediate space. By arranging the second venting passage and the control means relative to each other such that the second venting passage only can be in communication with the front space when the control means are in communication with the intermediate space and the first valve means is closed, it is avoided that the front space is vented while compressed air is supplied to the front space. The hammer device is thus configured such that the front piston portion, at rearward movement of the striking piston in the striking mechanism housing, never has passed the second venting passage before the rear piston portion has passed the control means. The first valve means and the control thereof are configured such that the venting of the front space is ensured during the forward movement of the striking piston in order to not decelerate the forward movement of the striking piston. This way, a hammer device which has an optimum striking energy is achieved.

According to an aspect of the present invention, the second venting passage is arranged so far back at the striking mechanism housing that the rear piston portion, during rearward movement in the striking mechanism housing, passes the control means before the front piston portion has passed the second venting passage. When the rear piston portion has passed the control means, the first valve means is closed and the supply of compressed air into the front space is stopped. The compressed air already existing in the front space and the kinetic energy of the striking piston, however, cause the striking piston to continue moving rearward during a period of time after the first valve means has been closed. When the kinetic energy of the striking piston ceases and the substantially constant pressure in the rear space decelerates the striking piston, the striking piston has moved so far back that the second venting passage is in communication with the front space. Thus, the front space is only vented after the energy of the air in the front space has been maximized. In this way, a hammer device having a high efficiency is achieved. Due to that the air which is discharged from the front space has a pressure near atmospheric pressure, the sound emissions emitted by the hammer device are also reduced.

Alternatively, the front space may be vented only through the first valve means in order to not decelerate the forward movement of the striking piston.

Alternatively, the hammer device comprises a plurality of venting passages, wherein the venting passages may be constituted by openings in the striking mechanism housing, arranged at different axially levels and/or circumferentially the periphery of the striking mechanism housing.

According to an aspect of the present invention, the hammer device comprises a supply conduit arranged in air flow communication with the compressed air conduit and the first valve means.

According to an aspect of the present invention, the connecting means of the hammer device comprises a second valve means arranged in communication with the compressed air conduit for regulation of the supply of compressed air. The second valve means is preferably arranged in connection with the supply conduit and the first passage. By providing a second valve means in connection with the compressed air conduit, regulation of the compressed air flow from the compressed air conduit through both the first passage into the rear space and through the supply conduit to the first valve means is achieved.

The second valve means may preferably be constituted by a ball valve or similar and is according to an aspect of the present invention constantly open when the hammer device is in operation. Thereby, a substantially constant pressure at the rear space is achieved which results in a substantially constant acceleration of the striking piston. Similarly, the supply conduit is constantly pressurized when the hammer device is in operation. The pressure build up which occurs in the striking mechanism housing of conventional hammer devices at the rear turning position of the striking piston causes equally large reaction forces on the striking mechanism housing as the pressure on the striking piston. These reaction forces cause vibrations in the striking mechanism housing. By the second valve means being constantly open, the air pressure conduit serves as accumulator when the striking piston is moved rearward and the rear space is compressed. In order to prevent the air in the rear space to decrease the rearward movement of the striking piston and to reduce the pressure buildup in the rear space, the air in the rear space must be transferred to the accumulator in pace with the striking piston moving rearward. When the striking piston is pressed rearward in the striking mechanism housing, the air in the rear space is thus pressed into the compressed air conduit again. Since the accumulator in the form of the compressed air conduit has a much larger volume than the rear space, the accumulator may reduce the pressure buildup in the striking mechanism and a substantially constant pressure in the rear space is obtained. Thereby, reaction forces are minimized during acceleration of the piston during its forward movement. This way, a hammer device is achieved which causes minimal vibrations. Since the second valve means is constantly open during operation of the hammer device air throttles causing pressure drop during acceleration of the striking piston are also avoided. In this way, a hammer device is achieved which has a high efficiency.

Alternatively, the connecting means of the hammer device comprise a coupling for direct connection of the compressed air conduit to the first passage. In this way, compressed air is supplied to the rear space when the external pressure source is activated and begins to generate compressed air. To stop the supply of compressed air to the rear space the external pressure source is switched off.

According to an aspect of the present invention, the hammer device is switched off by interrupting the supply of compressed air to the striking mechanism housing. Venting of the striking mechanism housing is preferably achieved when the supply of compressed air is stopped. Alternatively, the hammer device is switched off by interrupting the supply of compressed air to the rear space. Alternatively, the hammer device may be switched off by blocking the control conduit or by blocking the venting passages. Alternatively, the hammer device may be switched off by stopping the supply of compressed air to the front space at the same time as venting of the front space is achieved.

During use of a hammer device a feed force is required to counteract the generated reaction forces. The feed force is constituted by for example the force that an operator may apply to the hammer device. In cases where the hammer device is used vertically downwards the own weight of the hammer device also constitutes a part of the feed force. In order to achieve an ergonomic and user friendly hammer device, it is desirable to reduce the required feed force which an operator must provide. The higher the power of the hammer device is the larger feed force is required.

According to an aspect of the present invention, the hammer device comprises an external feed force supply source, such as a robot, rig, hydraulic or pneumatic feed pillar or the like.

According to an aspect of the present invention, the second valve means comprise a venting function. When the second valve means has been closed, the rear space is vented by the venting function to minimize the amount of compressed air in the rear space at the next start of the hammer device. By venting the rear space, the feed power supply is minimized at every new start of the hammer device. Alternatively, the hammer device comprises a separate venting device arranged at the first passage for venting of the rear space when the second valve means is closed. In this way, a hammer device is achieved, which is ergonomic and user friendly.

According to an aspect of the present invention, the hammer device comprises an actuating means arranged in communication with the second valve means for manually achieving the opening/closing of the second valve means. The actuating means may be a tap, which is rotated manually to open and close the second valve means.

According to an example embodiment, the actuating means is constituted by a servo valve. The servo valve may also be referred to as a pilot valve. The servo valve causes a power steering of the second valve means which facilitates the handling of the hammer device. The second valve means is subjected to a high pressure and high flow rates and should, in order to not reduce the pressure, be configured with large conduit areas. To manually open and close the second valve means would therefore require a high operating force. With the servo valve a restricted air flow is regulated, which air flow is in communication with the second valve means. The restricted airflow affects the second valve means such that it opens or closes. In this way a minimal operating force to activate/start the hammer device is required and an ergonomic and user friendly hammer device is thereby achieved.

According to an aspect of the present invention, the hammer device comprises a venting device arranged for venting of the front space. In the case where the hammer device comprises a second venting passage, the front space is vented when the striking piston is in a position such that the second venting passage is in communication with the front space. When the striking piston has been moved forward and has passed the second venting passage such that the second venting passage is in communication with the intermediate space, the front space is preferably vented through a venting device. When the striking piston is moved forward in the striking direction, the front space is compressed and accordingly the air in the front space is also compressed. The compressed air may slow down the forward movement of the striking piston. By venting the front space through the venting device during forward movement of the striking piston the decelerating effect on the striking piston is reduced. This way, a hammer device which has an optimum impact energy is achieved.

The venting device may preferably constitute a part of the first valve means. Alternatively, the venting device is constituted by a separate unit arranged at the second passage. In the case where the venting device constitutes a part of the first valve means, the first valve means is preferably configured such that the closed position of the first valve means causes the venting device to be opened and to vent the front space. In this way, the front space is vented as long as the first valve means is closed. The front space may thus be vented either through the second venting passage and the venting device, solely through the second venting passage or solely by the venting device.

According to an aspect of the present invention, the hammer device comprises an intermediate block arranged between the insert tool connected to the hammer device and the front portion of the striking piston. The front piston portion thereby strikes the intermediate block at a front position of the striking piston. The kinetic energy of the striking piston is transferred through the intermediate block to the insert tool which thus receives an amount of energy. The intermediate block receives reflexes from the insert tool when the feed force is too high. In this way, the load on the insert tool is reduced. Furthermore, the intermediate block prevents dirt from entering the front space of the striking mechanism housing.

Alternatively, the intermediate block is excluded and the front piston portion strikes directly on the insert tool. A sealing means is then arranged between the insert tool and the bushing. This ensures the pressure build up in the front space.

According to an aspect of the present invention, the hammer device comprises a rotation mechanism for rotation of the insert tool. Rotation of the insert tool is preferably achieved by a rotation of the bushing in which the insert tool is arranged at the front part of the hammer device. The rotation mechanism may comprise an external drive unit arranged at the hammer device. The external drive unit may be constituted by an electric motor, a hydraulic motor or a pneumatic motor. Alternatively, the rotating mechanism comprises so-called splines at the bushing and/or the striking piston, such that the rotation is achieved by the reciprocating motion of the striking piston.

According to an aspect of the present invention, the pneumatic hammer device is handheld. Alternatively, a carrier of the hammer device is mechanized.

According to an aspect of the present invention, a vehicle equipped with the pneumatic hammer device is provided. According to an aspect of the present invention, a rig, for example a drilling rig, equipped with the pneumatic hammer device is provided. According to an aspect of the present invention, a stationary platform equipped with the pneumatic hammer device is provided.

According to an aspect of the present invention, a method pertaining to a pneumatic hammer device is provided, which hammer device comprises connecting means arranged for connection to a compressed air conduit of an external compressed air source, and a striking mechanism, which striking mechanism comprises a striking mechanism housing and a striking piston arranged for reciprocating motion in said striking mechanism housing, which striking piston has a front piston portion and a rear piston portion, wherein the front piston portion affects an insert tool arranged at the hammer device, wherein the striking piston and the striking mechanism housing together form a front space and a rear space, wherein the front space is limited rearwards by the front piston portion and the rear space is limited forwards by the rear piston portion, wherein said compressed air conduit is arranged in air flow communication with the rear space via a first passage in the striking mechanism housing, and wherein said compressed air conduit is arranged in air flow communication with the front space via a second passage in the striking mechanism housing, at which second passage a first valve means is arranged, wherein the method comprises the step of:

controlling the first valve means by means of control means arranged to alternately be subjected to an air pressure at said rear space respectively an intermediate space formed between the striking mechanism housing, the front piston portion and the rear piston portion during the reciprocating motion of the striking piston, wherein the control means control said first valve means on the basis of the air pressure.

According to an aspect of the present invention, a method pertaining to a pneumatic hammer device is provided, comprising an compressed air conduit connected to a compressed air source and a striking mechanism with a striking piston movably arranged in the striking mechanism housing, which striking piston has a front piston portion and a rear piston portion, wherein the striking piston and the striking piston housing together form a front space and a rear space, wherein the front space is limited rearwards by the front piston portion and the rear space is limited forwards by the rear piston portion, wherein the compressed air conduit is arranged in communication with a first passage arranged at the rear space and a second passage arranged at the front space, at which second passage a first valve means is arranged, wherein the method comprises the steps of:

starting the hammer device;

achieving a movement of the striking piston forward in the striking mechanism housing by supplying compressed air via the first passage to the rear space;

achieving a movement of the striking piston rearward in the striking mechanism housing by supplying compressed air via the first valve means and the second passage to the front space; and switching off the hammer device.

According to an aspect of the present invention, the method comprises the step of starting the hammer device by activating the supply of compressed air to the rear space of the striking mechanism housing. Activation of the supply of compressed air to the rear space is preferably achieved by an operator manually activating an actuator means arranged in communication with a second valve means, wherein said second valve means is arranged in connection with the compressed air conduit and the rear space. By actuation, the second valve means opens and compressed air may flow into the rear space. The second valve means is preferably constantly open when the actuator means is activated, hi this way, a substantially constant pressure is supplied to the rear space during operation of the hammer device.

According to an aspect of the present invention, the method comprises the step of achieving a return movement of the striking piston by controlling the first valve means such that it opens and compressed air is supplied to the front space. The compressed air in the rear space substantially constantly presses the rear piston portion such that the striking piston moves forward. When the rear piston portion has passed control means arranged at the striking mechanism such that the control means are in communication with the rear space and thereby are subjected to the pressure in rear space, the first valve means is controlled to an open position. When the first valve means is open, compressed air from the compressed air conduit may be supplied to the front space. In this way, a pressure build up in the front space is achieved, which pressure affects the front piston portion such that the striking piston is moved rearward in the striking mechanism housing.

According to an aspect of the present invention, the method comprises the step of controlling the return movement of the striking piston by controlling the first valve means such that it closes and the supply of compressed air to the front space is stopped. When the rear piston portion, during its rearward movement, has passed the control means such that the control means are in communication with an intermediate space formed between the striking mechanism housing, the front piston portion and the rear piston portion and thereby are subjected to the pressure in the intermediate space, the first valve means is controlled to a closed position. The intermediate space is preferably in communication with the atmosphere. Alternatively, the intermediate space has an air pressure different from atmospheric pressure and from the air pressure of the rear space. The air pressure of the intermediate space is preferably lower than the air pressure of the rear space. When the first valve means has been closed, the striking piston continues to move rearward in the striking mechanism housing by its own kinetic energy until the pressure of the rear space fully decelerates the return movement of the of the striking piston.

According to an aspect of the present invention, the method comprises the step of venting the front space when the first valve means is closed, in order to minimize the decelerating effect when the striking piston obtains a forward movement.

According to an aspect of the present invention, the method comprises the step of switching off the hammer device by stopping the supply of compressed air to the striking mechanism housing. Preferably, the hammer device is switched off by stopping the supply of compressed air to the rear space. Alternatively, the hammer device may be switched off by blocking a control conduit connected to the first valve means or by blocking venting passages arranged at the striking mechanism housing. Alternatively, the hammer device is switched off by stopping the supply of compressed air to the front space at the same time as venting of the front space is achieved.

According to an aspect of the present invention, the method comprises the step of venting the rear space when the hammer device is switched off. The rear space is vented through for example a venting function of the second valve means. Alternatively, the rear space is vented by a separate venting device.

According to an aspect of the present invention, the method comprises venting the front space when the hammer device is switched off.

Additional objects, advantages and new features of the present invention will become apparent to those skilled in the art from the following details, as well as by practice of the invention. While the invention is described below, it should be understood that the invention is not limited to the specific details described. Those skilled in the art having access to the teachings herein will recognize additional applications, modifications and incorporations within other fields, which are within the scope of the invention.

BRIEF DESCRIPTION OF THE DRAWINGS

For a more complete understanding of the present invention and further objects and advantages thereof, reference is now made to the following detailed description to be read together with the accompanying drawings wherein equal reference numbers refer to equal parts in the various figures, and in which.

DETAILED DESCRIPTION OF THE DRAWINGS

In the description of the drawings position terms such as front, rear, forward and rearward are mentioned. Forward is here defined as a direction in the striking direction and rearward thus as a direction opposite to the striking direction.

Figure 1:
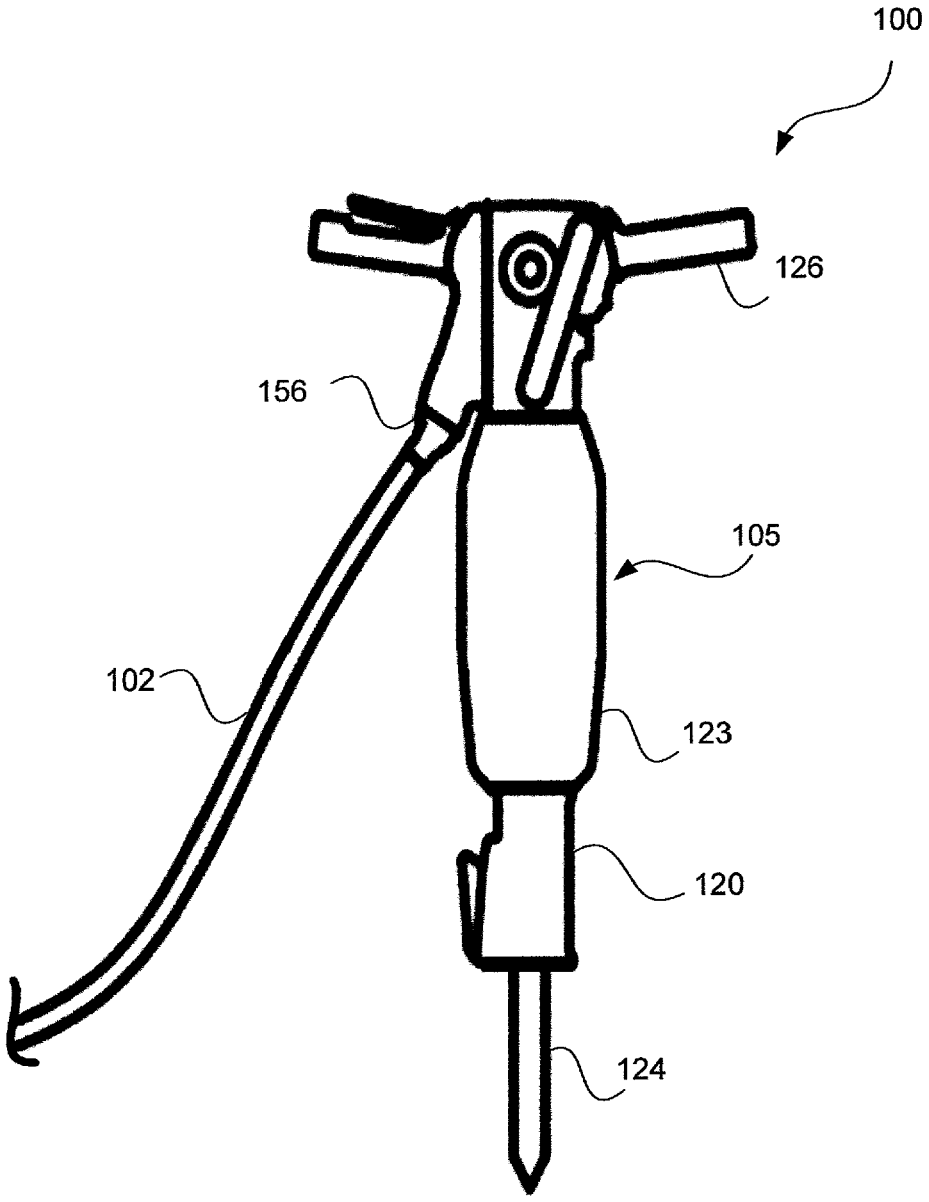
FIG. 1 schematically shows a hammer device according to an embodiment of the invention.

FIG. 1 schematically shows a hammer device 100 according to an embodiment of the present invention. The hammer device 100 comprises T-shaped handles 126, a striking mechanism 105 and connecting means 156 for connection to a compressed air conduit 102 of an external pressure source (not shown). The striking mechanism 105 comprises a striking mechanism housing (not shown), a striking piston (not shown) movably arranged at the striking mechanism housing and a front part 120 for connecting an insert tool 124 to the striking mechanism 105. The front part 120 is in this embodiment integrated with the striking mechanism housing and comprises a bushing/sleeve (not shown) to fit with the insert tool 124. The striking piston may be moved axially along the extension of the striking mechanism housing and strikes, in a front position, the insert the tool 124, which results in a transfer of energy to the insert tool 124. The pressure source which supplies compressed air to the hammer device 100 is suitably a compressor. The hammer device 100 also comprises a sound dampening housing 123 arranged around the striking mechanism 105.

Figure 2:
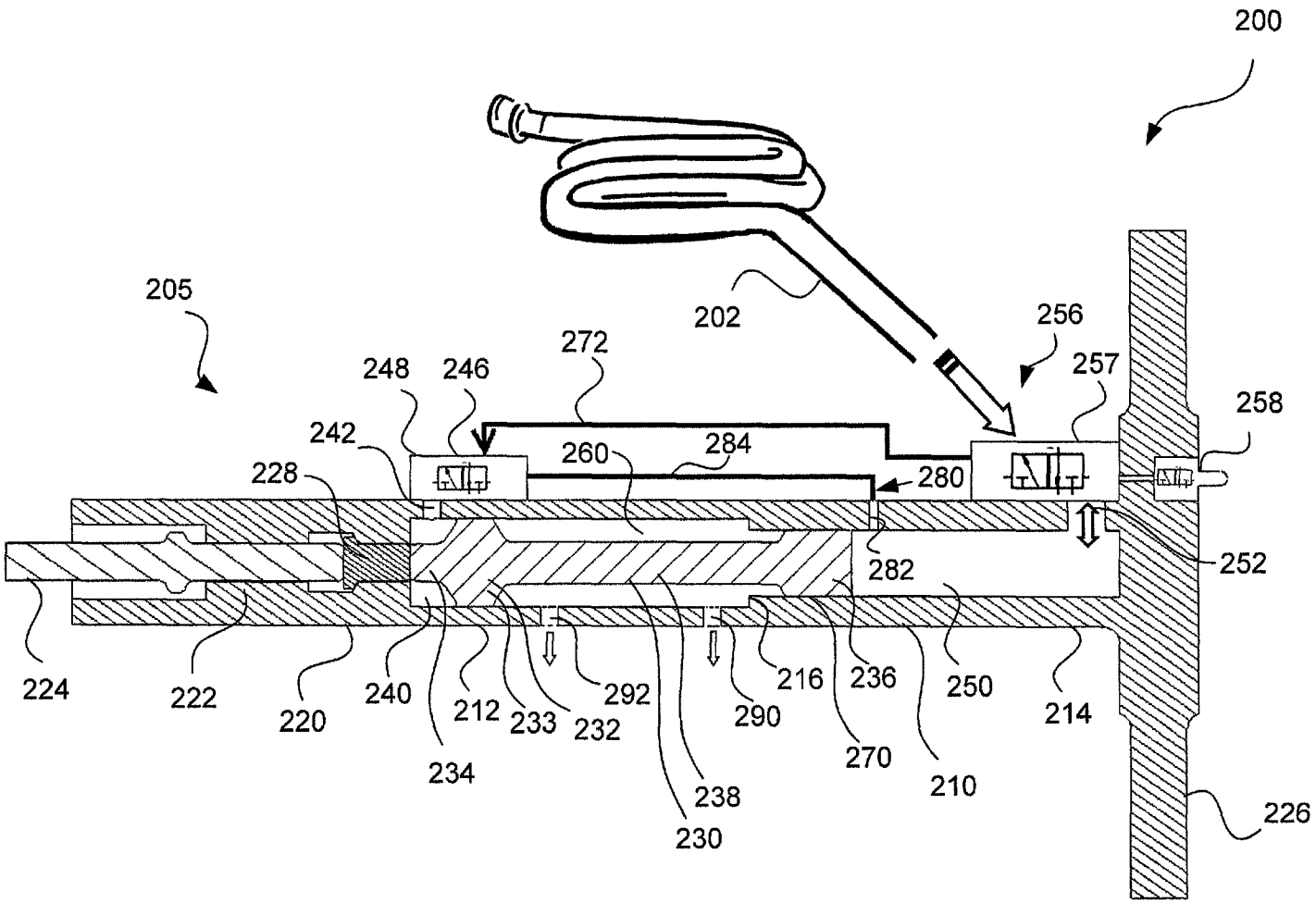
FIG. 2 schematically shows a cross sectional view of a striking mechanism of a hammer device according to an embodiment of the invention.

FIG. 2 schematically shows a cross sectional view of a hammer device 200 according to an embodiment of the present invention. The hammer device 200 comprises a striking mechanism 205. The striking mechanism 205 in turn comprises a striking mechanism housing 210, in which a striking piston 230 is arranged for a reciprocating motion along the extension of the striking mechanism housing 210. The striking mechanism housing 210 is configured as a cylinder and has a front portion 212 and a rear portion 214, wherein the front portion 212 has a larger inner diameter and thereby a larger exposed area than the rear portion 214. A contact surface 216 is formed at the diameter transition between the front portion 212 and the rear portion 214. Integrated with the front portion 212 of the striking mechanism housing 210 a front part 220 with a bushing 222 is arranged for connection of an insert tool 224 to the hammer device 200. At the rear portion 214 of the striking mechanism housing 210 the handles 226 of the hammer device 200 are arranged. Between the striking mechanism housing 210 and the front part 220 an intermediate block 228 is arranged. When the striking piston 230 moves forward to a front position, the striking piston 230 strikes the intermediate block 228. The intermediate block 228 then transfers the kinetic energy of the striking piston 230 to the insert tool 224. The intermediate block 228 also prevents dirt from entering the striking mechanism housing 210.

The striking piston 230 is configured with a front piston portion 232 and a rear piston portion 236 and an intermediate portion 238 extending there between. The front piston portion 232 impacts, in the front position of the striking piston 230, the insert tool 224 which is connected to the hammer device 200, such that an energy transfer to the insert tool 224 is achieved. The front piston portion 232 comprises a first portion 233 and a second portion 234, wherein the first portion 233 has a larger diameter than the second portion 234. The second portion 234 of the front piston portion 232 is the portion that abuts the intermediate block 228 upon striking. The first portion 233 of the front piston portion 232 has substantially the same diameter as the inner diameter of the front portion 212 of the striking mechanism housing 210. The front piston portion 232 thus forms a front space 240 together with the striking mechanism housing 210. The front space 240 is thus limited rearwards by the first portion 233 of the front piston portion 232 and limited forwards by the intermediate block 228 and the striking mechanism housing 210. The rear piston portion 236 has a smaller diameter than the first portion 233 of the front piston portion 232. The rear piston portion 236 has substantially the same diameter as the inner diameter of the rear portion 214 of the striking mechanism housing 210. The rear piston portion 236 thereby forms a rear space 250 together with the striking mechanism housing 210. The intermediate portion 238 of the striking piston 230 has a smaller diameter than the first portion 233 of the front piston portion 232 and the rear piston portion 236 such that an intermediate space 260 is formed between the striking mechanism housing 210, the front piston portion 232 and the rear piston portion 236. The front space 240, the intermediate space 260 and the rear space 250 are separated and sealed by slot seals 270, radially between the first portion 233 of the front piston portion 232 and the striking mechanism housing 210 and between the rear piston portion 236 and the striking mechanism housing 210. The slot 270 between the striking piston 230 and the striking mechanism housing 210 is between 10-60 micrometers. By using the slot sealing 270, the friction between the striking piston 230 and the striking mechanism housing 210 is minimized. In this way, a hammer device 200 which has an optimized striking effect is achieved.

The hammer device 200 further comprises connecting means 256 for connection to a compressed air conduit 202 of an external compressed air source (not shown). The compressed air conduit 202, in the form of a hose, is arranged in air flow communication with the rear space 250 of the striking mechanism housing 210 via a first passage 252 in the striking mechanism housing 210, and the front space 240 of the striking mechanism housing 210 via a second passage 242. At the second passage 242 a first valve means 246 is arranged. The first valve means 246 is arranged to regulate the supply of compressed air to the front space 240 via the second passage 242. The connecting means 256 comprises a second valve means 257 arranged to regulate the air flow between the air conduit 202 and rear space 250. Further, an actuator means 258 in the form of a servo valve is arranged in communication with the second valve means 257. The servo valve 258 is manually operated by an operator, via for example a button, a lever or the like (not shown) and a power steering of the second valve means 257 is thereby achieved. By activating the servo valve 258, the second valve means 257 opens and the hammer device 200 is started. When the servo valve 258 is deactivated the second valve means 257 is closed and the hammer device 200 is stopped. As long as the servo valve 258 is activated, the second valve means 257 is maintained open and compressed air is thereby constantly supplied to the rear space 250 during use of the hammer device 200. Between the second valve means 257 and the first valve means 246 is a feed conduit 272 arranged for feeding of compressed air from the compressed air conduit 202 to the front space 240. When the servo valve 258 is activated and the second valve means 257 is open, the feed conduit 272 is substantially constantly pressurized.

The hammer device 200 further comprises control means 280 for controlling the first valve means 246 and thereby controlling the compressed air supply to the front space 240. The control means 280 comprise a control passage 282 at the striking mechanism housing 210, and a control conduit 284 connected between the control passage 282 and the first valve means 246. The control conduit 284 is constituted by a hose. The control passage 282 is arranged such that it alternately is in communication with the rear space 250 respectively the intermediate space 260, depending on the position of the striking piston 230 in the striking mechanism housing 210. In this way, the control passage 282 and thereby the control conduit 284 are alternately subjected to an air pressure of the rear space 250 and an air pressure of the intermediate space 260 during the reciprocating motion of the striking piston 230. The first valve means 246 is controlled based on the air pressure which the control means 280 are subjected to.

A first venting passage 290 is arranged in the striking mechanism housing 210 such that that the intermediate space 260 is in constantly communication with the atmosphere. This way, an atmospheric pressure is maintained in the intermediate space 260, regardless of the position of the striking piston 230.

A second venting passage 292 is further arranged in the striking mechanism housing 210 such that it is in communication with the front space 240 only when the control means 280 are in communication with the intermediate space 260.

When an operator activates the servo valve 258, the second valve means 257 opens such that air freely can flow between the compressed air conduit 202 and the rear space 250 via the first passage 252. The compressed air in the rear space 250 affects the rear piston portion 236 such that the striking piston 230 is pressed forward in the striking direction. When the rear piston portion 236 has passed the control passage 282 (as shown in the figure) the compressed air of the rear space flows into the control conduit 284. The air in the control conduit 284 then has the same pressure as the air of the rear space 250. The first valve means 246 is a mechanically controlled 3/2 valve having a first closed idle position and a second controlled open position. In the idle position, the valve 246 is closed to the front space 240 such that no compressed air may be supplied to the front space 240. The valve 246 comprises a venting device 248 by also being connected to the atmosphere in the idle position. The idle position thus results in that the front space 240 is vented. When the pressure in the control conduit 284 increases to the same pressure as that of the rear space 250, the compressed air controls the first valve means 246 to its second position. The controlled second position causes the valve 246 to be opened to the front space 240 and the compressed air in the supply conduit 272 may be supplied to the front space 240 via the second passage 242. The positioning of the control passage 282 is adapted such that the first valve means 246 not will switch and open until the striking piston 230 has reached the insert tool 224.

When the first valve means 246 is open, the front space 240 is filled with compressed air while the rear space 250 constantly is supplied with compressed air. Since the first portion 233 of the front piston portion 232 has a larger diameter, and thereby area, than the rear piston portion 236, the striking piston 230 is pressed rearward in the striking mechanism housing 210. The volume of the rear space 250 thereby decreases and the air in the rear space 250 flows due to the constantly open second valve means 257 back into the compressed air conduit 202 which thus serves as an accumulator. The accumulator in the form of the compressed air conduit 202 is so much larger than the rear space 250 that the rear space 250 obtains a substantially constant pressure and thus achieves a substantially constant acceleration of the striking piston 230 both during its forward and return movement. The substantially constant pressure results in substantially constant reaction forces and thereby minimizes the vibrations in the striking mechanism 205.

The striking piston 230 is thus moved rearward in the striking mechanism housing 210 and when the rear piston portion 236 has passed the control passage 282, the control passage 282 and the control conduit 284 are in communication with the intermediate space 260 instead of the rear space 250. The intermediate space 260 is in constant communication with the atmosphere via the first venting passage 290, causing the compressed air in the control conduit 284 to flow out to the atmosphere and the pressure in the control conduit 284 is substantially reduced to atmospheric pressure. When the pressure in the control conduit 284 is reduced, the first valve means 246 returns to its closed idle position and the supply of compressed to the front space 240 is stopped. The striking piston 230 will however move rearward in the striking mechanism housing 210 as long as the energy of the air in the front space 240 and the kinetic energy in the striking piston 230 is greater than the pressure on the rear piston portion 236 in the rear space 250. Finally, the striking piston 230 has been moved rearward so far that the first portion 233 of the front piston 232 is positioned behind the second venting passage 292, such that the second venting passage 292 is in communication with the front space 240. In this way, the front space 240 is vented through the second venting passage 292. The air discharged through the second venting passage 292 thus has a relatively low pressure and therefore contains a lower energy. This reduces the sound emissions from the hammer device 200 and a high efficiency is obtained. When the compressed air in the rear space 250 affects the striking piston 230 and the striking piston 230 is moved forward, the front space 240 is compressed. Due to that the front space 240 is vented via the second venting passage 292 there is substantially no compressed air which significantly decelerates the forward movement of the striking piston 230. The front space 240 is also vented via the venting device 248 of the first valve means 246 the whole time when the first valve means 246 is in its closed idle position which further minimizes the deceleration of the forward movement of the striking piston 230. By configuring the hammer device 200 according to the present invention, an optimal timing between the position of the striking piston 230 and the control of the supply of compressed air to the front space 240 is achieved, in this way mechanical stopping of the striking piston 230 when the hammer device 200 is in use is prevented.

To switch off the hammer device 200, the servo valve 258 is inactivated and the second valve means 257 is closed. By throttling all supply of compressed air to the hammer device 200 during switching off, the internal leakage is minimized when the hammer device 200 is switched off. The second valve means 257 comprises a venting function. When the second valve means 257 has been closed the rear space 250 is thus vented through the venting function to minimize the amount of compressed air in the rear space 250 at the next start of the hammer device 200. By venting the rear space 250, the feed power demand is minimized at every new start of the hammer device 200. When the hammer device 200 is switched off, the striking piston's 230 eventual rearward movement is stopped by the first portion 233 of the front piston portion 232 being received by the contact surface 216 at the diameter transition of the striking mechanism housing 210.

Figure 3A:
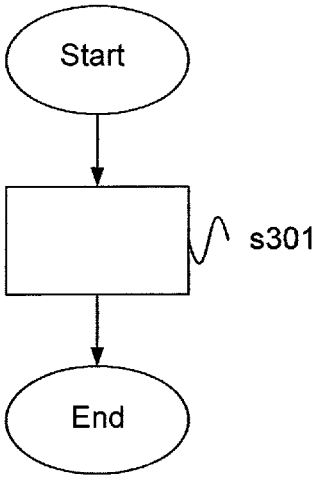
FIG. 3*a* schematically shows a flow chart of a method according to an embodiment of the invention.

FIG. 3*a* shows a flow chart of a method pertaining to a pneumatic hammer device 200 according to an embodiment of the present invention. The hammer device 200 comprises connecting means 256 arranged for connection to a compressed air conduit 202 of an external compressed air source and a striking mechanism 205. The striking mechanism 205 comprises a striking mechanism housing 210 and a striking piston 230 arranged for reciprocating motion in said striking mechanism housing 210, which striking piston 230 has a front piston portion 232 and a rear piston portion 236, wherein the front piston portion 232 affects an insert tool 224 arranged at the hammer device 200, wherein the striking piston 230 and the striking mechanism housing 210 together form a front space 240 and a rear space 250, wherein the front space 240 is limited rearwards by the front piston portion 232 and the rear space 250 is limited forwards by the rear piston portion 236, wherein said compressed air conduit 202 is arranged in air flow communication with the rear space 250 via a first passage 252 in the striking mechanism housing 210, and wherein said compressed air conduit 202 is arranged in air flow communication with the front space 240 via a second passage 242 in the striking mechanism housing 210, at which second passage 242 a first valve means 246 is arranged.

The method comprises a first method step s301. The step s301 comprises controlling the first valve means 246 by means of control means 280 arranged to alternately be subjected to an air pressure of said rear space 250 respectively an intermediate space 260, formed between the striking mechanism housing 210, the front piston portion 232 and the rear piston portion 236, during the reciprocating motion of the striking piston 230, wherein the control means 280 controls said first valve means 246 on the basis of said air pressure. After the method step s301 the method ends.

Figure 3B:
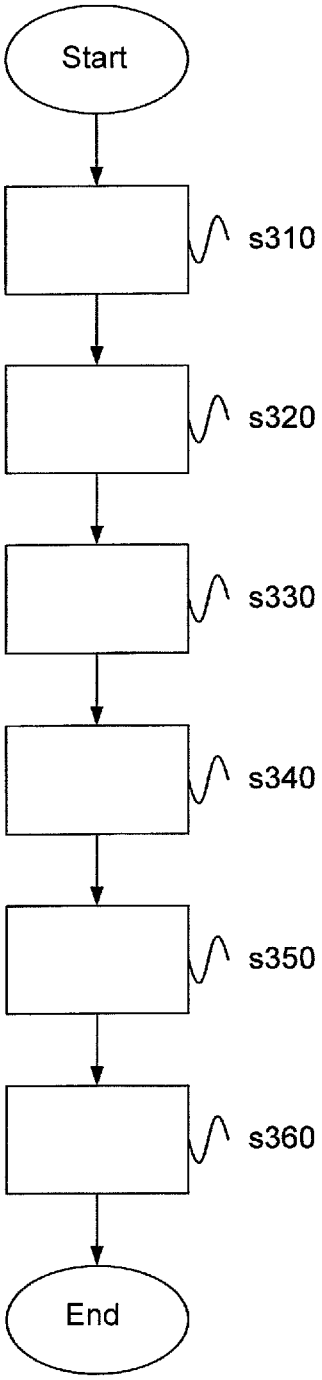
FIG. 3*b* in further detail schematically shows a flow chart of a method according to an embodiment of the invention.

FIG. 3*b* shows a flow chart of a method pertaining to a pneumatic hammer device 200 according to an embodiment of the present invention. The hammer device 200 comprises connecting means 256 arranged for connection to a compressed air conduit 202 of an external compressed air source and a striking mechanism 205. The striking mechanism 205 comprises a striking mechanism housing 210 and a striking piston 230 arranged for reciprocating motion in said striking mechanism 210, which striking piston 230 has a front piston portion 232 and a rear piston portion 236, wherein the front piston portion 232 affects an insert tool 224 arranged at the hammer device 200, wherein the striking piston 230 and striking mechanism housing 210 together form a front space 240 and a rear space 250, wherein the front space 240 is limited rearwards by the front piston portion 232 and the rear space 250 is limited forwards by the rear piston portion 236, wherein said compressed air conduit 202 is arranged in air flow communication with the rear space 250 via a first passage 252 in the striking mechanism housing 210, and wherein said compressed air conduit 202 is arranged in air flow communication with the front space 240 via a second passage 242 in the striking mechanism housing 210, at which second passage 242 a first valve means 246 is arranged.

The method comprises a first method step s310. The step s310 comprises starting the hammer device 200 by activating the supply of compressed air to the rear space 250 of the striking mechanism housing 210. After the method step s310 has been performed a subsequent method step S320 is performed.

Method step s320 comprises providing a forward movement of the striking piston 230 in the striking mechanism housing 210 towards a forward position of the striking piston 230, in which the striking mechanism 230 strikes an insert tool 224 arranged at the hammer device 200. After the method step s320 a subsequent method step s330 is performed.

Method step s330 comprises providing a return movement of the striking piston 230 by controlling the first valve means 246 such that it opens and compressed air is supplied to the front space 240. When the rear piston portion 236 has passed control means 280 arranged at the striking mechanism housing 210 such that the control means 280 are in communication with the rear space 250 and thereby are subjected to the pressure in rear space 250, the first valve means 246 is controlled to an open position. In this way a pressure build up is achieved in the front space 240, which pressure affects the front piston portion 232 such that the striking piston 230 is moved rearward in the striking mechanism housing 210. After the method step s330 a subsequent method step s340 is performed.

Method step s340 comprises controlling the return movement of the striking piston 230 by controlling the first valve means 246 such that it is closed and the supply of compressed air to the front space 240 is stopped. When the rear piston portion 236 during its rearward movement has passed the control means 280 such that the control means 280 are in communication with an intermediate space 260 formed between the striking mechanism housing 210, the front piston portion 232 and the rear piston portion 236, and thereby are subjected to the pressure in the intermediate space 260, the first valve means 246 is controlled to a closed position. When the first valve means 246 has been closed, the striking piston 230 continues to move rearward in the striking mechanism housing 210 by its own kinetic energy until the pressure of the rear space 250 completely decelerates the rearward movement of the striking piston 230. After the method step s340 a subsequent method step s350 is performed.

Method step s350 comprises venting the front space 240 when the first valve means 246 is closed, in order to minimize the decelerating effect when the striking piston 230 is pressed forward again. After the method step s350 a subsequent method step s360 is performed.

Method step s360 comprises switching off the hammer device 200 by interrupting the supply of compressed air to the striking mechanism housing 210 and venting the striking mechanism housing 210. The method is ended after the method step s360.

The foregoing description of the preferred embodiments of the present invention has been provided for the purpose of illustrating and describing the invention. It is not intended to be exhaustive or to limit the invention to the variants described. Obviously, many modifications and variations will be apparent to those skilled in the art. The embodiments were chosen and described in order to best explain the principles of the invention and its practical applications, and thereby allowing the person skilled in the art to understand the invention for various embodiments and with the various modifications suitable for the intended use.

The invention claimed is:

1. A pneumatic hammer device, comprising:

a connector configured to be connected to a compressed air conduit of an external compressed air source, and a striking mechanism comprising a striking mechanism housing and a striking piston arranged for reciprocating motion in said striking mechanism housing, the striking piston having a front piston portion and a rear piston portion, wherein the front piston portion affects an insert tool arranged at the hammer device, wherein the striking piston and the striking mechanism housing together form a front space and a rear space, wherein the front space is limited rearwards by the front piston portion and the rear space is limited forwards by the rear piston portion, wherein said compressed air conduit is arranged in air flow communication with the rear space via a first passage in the striking mechanism housing, and wherein said compressed air conduit is arranged in air flow communication with the front space via a second passage in the striking mechanism housing, at which second passage a first valve is arranged, wherein the striking piston is configured such that an intermediate space is formed between the front piston portion and the rear piston portion and the striking mechanism housing, wherein a control unit is arranged to alternately be subjected to an air pressure at said rear space and said intermediate space respectively during the reciprocating motion of the striking piston, and wherein said control unit is arranged to control said first valve on the basis of said air pressure to alternately supply compressed air to the front space and achieve a return movement of the striking piston.

2. The pneumatic hammer device according to claim 1, further comprising:

a first venting passage arranged at said striking mechanism housing for maintaining atmospheric pressure at said intermediate space.

3. The pneumatic hammer device according to claim 1, wherein the control unit comprises a control passage arranged at said striking mechanism housing and a control conduit arranged between the control passage and the first valve.

4. The pneumatic hammer device according to claim 1, further comprising:

a second venting passage arranged at the striking mechanism housing such that the second venting passage is in communication with the front space when the control unit is in communication with the intermediate space.

5. The pneumatic hammer device according to claim 1, further comprising a feed conduit arranged in air flow communication with the compressed air conduit and the first valve.

6. The pneumatic hammer device according to claim 1, wherein the connector comprises a second valve arranged in connection with the air conduit for controlling the supply of compressed air.

7. The pneumatic hammer device according to claim 6, further comprising:

an actuator arranged in communication with the second valve, in order to manually achieve the opening/closing of the second valve.

8. The pneumatic hammer device according to claim 7, wherein the actuator comprises a servo valve.

9. The pneumatic hammer device according to claim 1, further comprising:

a venting device arranged for venting of said front space.

10. The pneumatic hammer device according to claim 1 further comprising:

an intermediate block arranged between the insert tool and the front portion of the striking piston.

11. The pneumatic hammer device according to claim 1, further comprising:

a rotation mechanism for rotation of the insert tool.

12. A method pertaining to a pneumatic hammer device comprising a connector arranged for connection to a compressed air conduit of an external compressed air source and a striking mechanism comprising a striking mechanism housing and a striking piston arranged for reciprocating motion in said striking mechanism housing, the striking piston further comprising a front piston portion and a rear piston portion, wherein the front piston portion affects an insert tool arranged at the hammer device, wherein the striking piston and the striking mechanism housing together form a front space and a rear space, wherein the front space is limited rearwards by the front piston portion and the rear space is limited forwards by the rear piston portion, wherein said compressed air conduit is arranged in air flow communication with the rear space via a first passage in the striking mechanism housing, and wherein said compressed air conduit is arranged in air flow communication with the front space via a second passage in the striking mechanism housing, at which second passage a first valve is arranged, the method comprising:

controlling the first valve with a control unit arranged to be alternately subjected to an air pressure of said rear space and an intermediate space respectively, during the reciprocating motion of the striking piston, wherein said intermediate space is formed between the striking mechanism housing, the front piston portion and the rear piston portion, wherein the control unit controls said first valve based on said air pressure to alternately supply compressed air to the front space and achieve a return movement of the striking piston.

13. The method pertaining to a pneumatic hammer device according to claim 12, further comprising:

controlling said first valve such that the first valve opens and supplies compressed air to said front space when the striking piston is positioned such that the control is in communication with the rear space, in order to achieve a rearward movement of the striking piston in the striking mechanism housing.

14. The method pertaining to a pneumatic hammer device according to claim 12, further comprising:

controlling said first valve such that the first valve closes when the striking piston is positioned such that the control unit is in communication with the intermediate space.

15. The method pertaining to a pneumatic hammer device according to claim 12, further comprising:

venting said front space when the first valve is closed.

* * * * *